US012059721B2

(12) United States Patent
Pirrello et al.

(10) Patent No.: US 12,059,721 B2
(45) Date of Patent: Aug. 13, 2024

(54) METHOD AND SYSTEM FOR ON-DEMAND RETAINING RING FORMING AND INSTALLATION

(71) Applicant: BeijingWest Industries Co., Ltd., Beijing (CN)

(72) Inventors: Frank Gerard Pirrello, Dayton, OH (US); Steven Edward Pyle, Lebanon, OH (US); Michael James Chisom, Springboro, OH (US); Tania Tannahill, Englewood, OH (US); John Lee Forsyth, Dayton, OH (US); Thomas L. Fugate, Jr., Dayton, OH (US)

(73) Assignee: BEIJINGWEST INDUSTRIES CO., LTD., Beijing (CN)

( * ) Notice: Subject to any disclaimer, the term of this patent is extended or adjusted under 35 U.S.C. 154(b) by 0 days.

(21) Appl. No.: 17/983,238

(22) Filed: Nov. 8, 2022

(65) Prior Publication Data

US 2024/0149329 A1 May 9, 2024

(51) Int. Cl.
*B21F 37/02* (2006.01)

(52) U.S. Cl.
CPC ..... *B21F 37/02* (2013.01)

(58) Field of Classification Search
CPC ..... B21F 37/00; B21F 37/02
USPC ..... 140/88; 72/133, 169, 135, 137, 352, 371
See application file for complete search history.

(56) References Cited

U.S. PATENT DOCUMENTS 1,856,243 A * 5/1932 Ekstedt ..... H01K 3/04 313/344
1,899,343 A * 2/1933 Mackey ..... F16B 3/04 411/113
2,128,437 A * 8/1938 Stenwall ..... B21D 53/16 269/48
2,742,061 A 4/1956 Anderson et al.
(Continued)

FOREIGN PATENT DOCUMENTS

DE 102006014154 A1 5/2007
EP 3991873 A1 5/2022
JP 59150640 A 8/1984

OTHER PUBLICATIONS

Extended European Search Report issued on Apr. 4, 2024 for counterpart European patent application No. 23207962.4.
(Continued)

*Primary Examiner* — Jason L Vaughan
(74) *Attorney, Agent, or Firm* — William H. Honaker; Dickinson Wright PLLC

(57) ABSTRACT

A method for forming and installing a retaining ring comprises: feeding a wire in a linear path into a forming die having a circular bore; forming, using the forming die, the wire into a formed ring having a ring shape; transferring the formed ring from the forming die to a transfer puck; and installing the formed ring, as a retaining ring, in a tube of a product assembly. The formed ring is maintained in a constrained state between forming in the forming die and installation in the product assembly. A system for forming and installing a retaining ring into a product assembly includes a forming die configured to form a wire into a
(Continued)

formed ring having a ring shape; and a transfer puck to transfer the formed ring from the forming die. The formed ring is maintained in a constrained state from forming through installation.

8 Claims, 8 Drawing Sheets

(56) References Cited

U.S. PATENT DOCUMENTS 3,030,488 A * 4/1962 Kuckens ..... B21C 37/122 72/135
3,086,228 A * 4/1963 Mellowes ..... B21D 53/20 72/132
3,451,124 A * 9/1969 Steiner ..... B21D 53/40 264/269
3,468,148 A * 9/1969 Tsurumoto ..... B21F 37/02 72/142
3,613,195 A * 10/1971 Senior ..... B01D 25/001 470/197
3,805,352 A * 4/1974 de Montremy ..... F16J 9/12 277/924
3,986,635 A 10/1976 Niskin
4,621,515 A 11/1986 Sanderson et al.
4,771,678 A 9/1988 Walker
4,872,618 A * 10/1989 Sato ..... H01F 41/08 29/605
4,928,510 A * 5/1990 Hillsted ..... B21F 37/00 72/131
7,296,452 B2 11/2007 Sumimoto
7,350,453 B1 4/2008 Bailey et al.
9,810,322 B2 11/2017 Bueter
10,954,984 B2 3/2021 Breen et al.

OTHER PUBLICATIONS

Burggraf Peter et al., Layoutplanung Handbuch Produktion und Management 4, Jan. 1, 2021.

* cited by examiner

METHOD AND SYSTEM FOR ON-DEMAND RETAINING RING FORMING AND INSTALLATION

BACKGROUND OF THE INVENTION

1. Field of the Invention

The present disclosure relates generally to systems and methods for forming and installing retaining rings. More specifically, the present disclosure relates to an on-demand method and system for forming retaining rings as needed for installation in a manufactured assembly.

2. Related Art

Conventional solutions for assembling retaining rings may include forming a length of wire using a die. Retaining rings are typically manufactured separately from their installation in a manufactured assembly, such as a damper tube for a shock absorber.

Shipping density and storage of retaining rings can cause variation of dimensions. Detangling, aligning, loading and gaging of retaining rings on mandrels prior to installation can be very labor intensive. Automated singulation and alignment of retaining rings requires precise escapement and gripper alignment for retainer rings in an unconstrained state. Furthermore, once the retainer rings are in an unconstrained state, flatness, roundness and/or orientation may need to be re-established during material handling.

SUMMARY OF THE INVENTION

The present disclosure provides a method for forming and installing a retaining ring. The method comprises: feeding a wire in a linear path into a forming die having a circular bore; forming, using the forming die, the wire into a formed ring having a ring shape; transferring the formed ring from the forming die to a transfer puck; and installing the formed ring, as a retaining ring, in a tube of a product assembly. The formed ring is maintained in a constrained state between forming in the forming die and installation in the product assembly.

The present disclosure also provides a system for forming and installing a retaining ring into a product assembly. The system includes a forming die configured to form a wire into a formed ring having a ring shape; and a transfer puck configured to transfer the formed ring from the forming die. The system is configured to maintain the formed ring in a constrained state between forming in the forming die and installation in a product assembly.

The present disclosure also provides a system for forming and installing a retaining ring into a product assembly. The system includes a forming die configured to form a wire into a formed ring having a ring shape. The system also includes a tubular die configured to cooperate with a roller mandrel to form the formed ring into the retaining ring; and a transfer puck configured to transfer the formed ring from the forming die to the tubular die. The transfer puck includes a tapered groove configured to align the transfer puck with at least the forming die.

BRIEF DESCRIPTION OF THE DRAWINGS

Further details, features and advantages of designs of the invention result from the following description of embodiment examples in reference to the associated drawings.

DESCRIPTION OF THE ENABLING EMBODIMENTS

Figure 1:
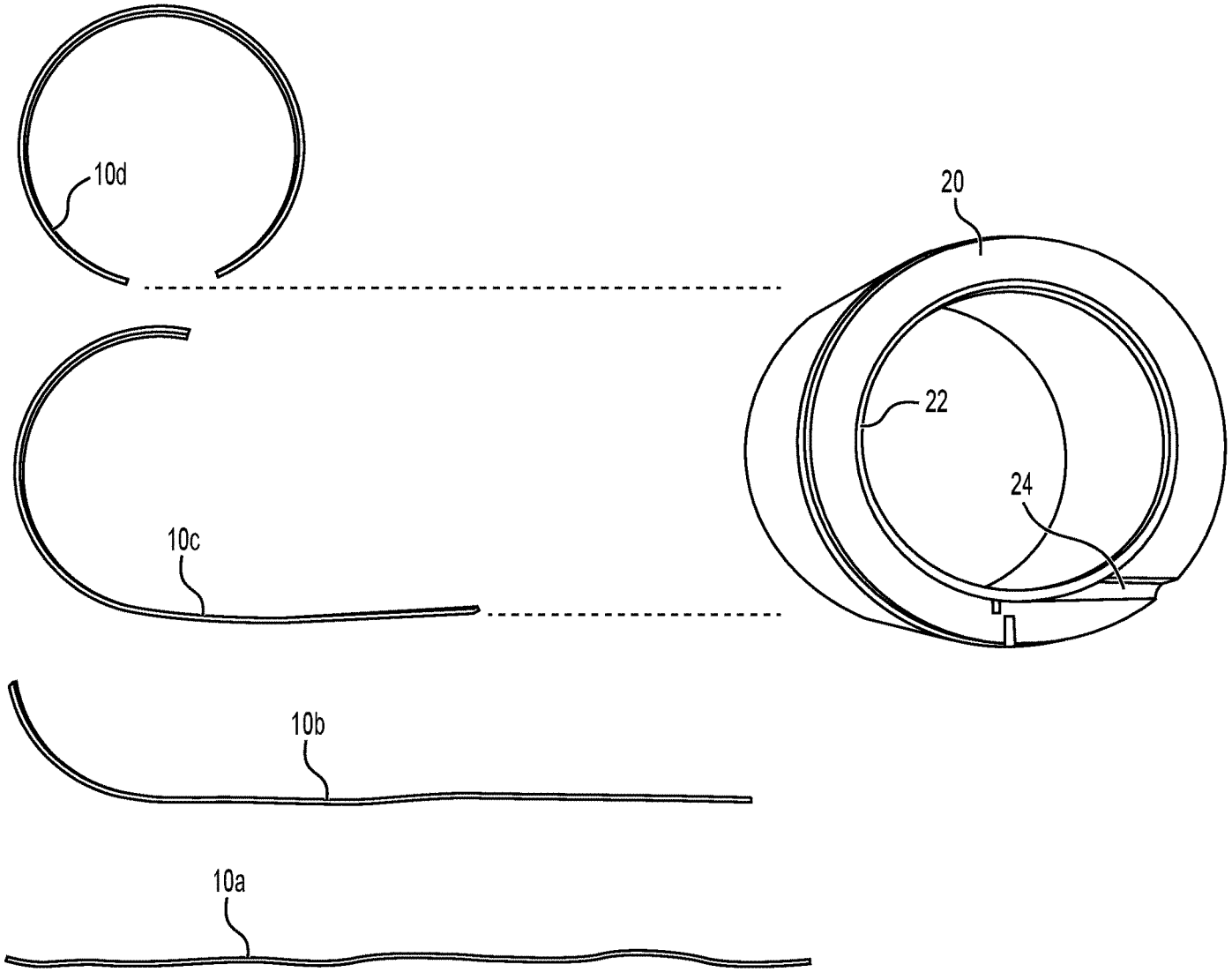
FIG. 1 shows a progression of forming a segment of wire into a formed ring having a ring shape and a forming die for forming the segment of wire into the ring shape, according to an aspect of the present disclosure.

Referring to the drawings, the present invention will be described in detail in view of following embodiments.

The present disclosure pertains to a system and process for on-demand or Just-in-Time (JIT) forming and installation of retainer rings. Such retainer rings may be used for retaining structures within a tubular assembly. The retainer ring forming and installation process may be implemented to form and install retainer rings for holding valve assemblies in a damper tube for a suspension damper assembly. However, the retainer ring forming and installation process of the present application may be applied to other assemblies, such as brake boosters, etc.

FIG. 1 shows a progression of forming a segment of wire 10*a* into a formed ring 10*d* having a ring shape and a forming die 20 for forming the segment of wire 10*a* into the formed ring 10*d*. The method and system provides for forming and installing individual retaining rings on demand from a pre-cut segment of stainless steel wire 10*a* such that each retaining ring is fully constrained by tooling until assembled into a pallet assembly tube.

The forming process illustrated on FIG. 1 includes moving the segment of wire 10*a* along a linear path as illustrated by the dashed line on FIG. 1 to push the segment of wire 10*a* into a forming die 20 having a circular bore 22 with a tangential aperture 24 that extends tangentially to an inside surface of the circular bore 22. In this way, the segment of wire 10*a* is progressively bent, as shown in steps progressive steps and corresponding bent wires 10*b* and 10*c* until it is shaped as the formed ring 10*d* with the shape of the circular bore 22. The formed ring 10*d* may be close to a 360-degree ring, although it may still include a gap between ends thereof.

Figure 2:
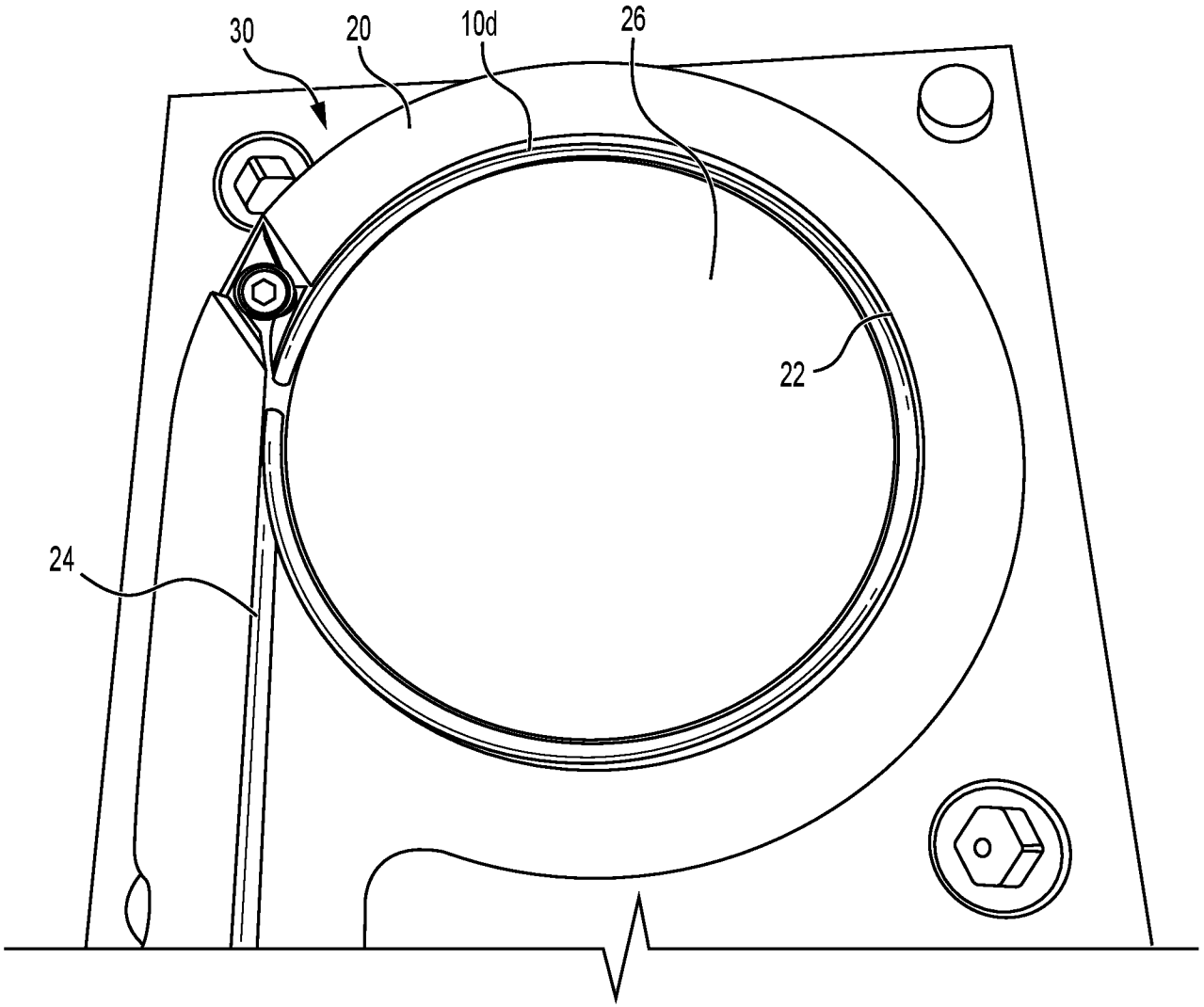
FIG. 2 shows a forming assembly for producing the formed ring, according to an aspect of the present disclosure.

FIG. 2 shows a forming assembly 30 for producing the formed ring 10*d*. The forming assembly 30 includes the forming die 20 with the circular bore 22 and the tangential aperture 24 for receiving the wire segment 10*a* for forming into the formed ring 10*d*. The forming assembly 30 also include an inner tool 26 that is free to rotate and can be utilized to transfer the formed ring 10*d* into a transfer tooling.

Figure 3:
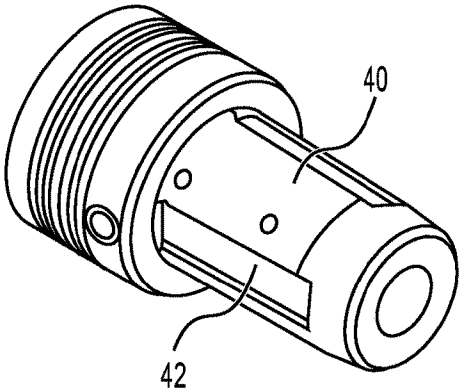
FIG. 3 shows a perspective view of a roller mandrel.
Figure 4B:
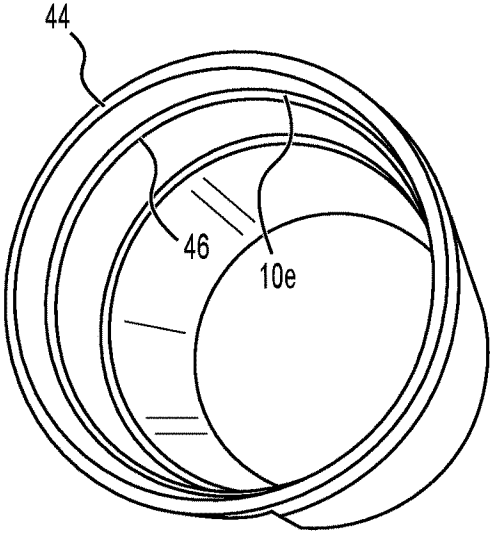
FIG. 4B shows the tubular die holding a retaining ring formed by expanding the formed ring by the roller mandrel.
Figure 4A:
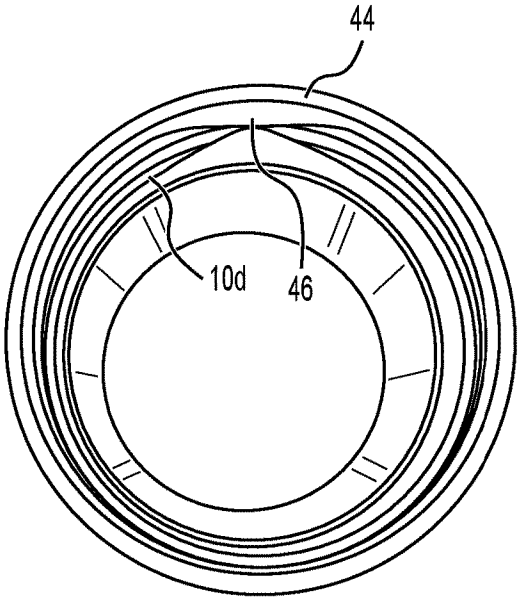
FIG. 4A shows a tubular die holding the formed ring before forming with the roller mandrel.

FIG. 3 shows a perspective view of a roller mandrel 40 having non-helical rollers 42. The roller mandrel 40 is used with a tubular die 44, shown in FIGS. 4A-4B to form expand the formed ring 10*d* into a retaining ring 10*e*. FIG. 4A shows the tubular die 44 with the formed ring 10*d* before roll-forming, and FIG. 4B shows the tubular die 44 with the retaining ring 10*e* formed by roll-forming. The formed ring 10*d* may be first located in the tubular die 44 having a retaining groove 46, and then the roller mandrel 40 is inserted therein and rotated so the rollers 42 push the formed ring 10*d* outwardly to form the retaining ring 10*e*. The roller mandrel 40 may include a conventional tool, such as part No. B11004 from Monaghan Tool.

Figure 5:
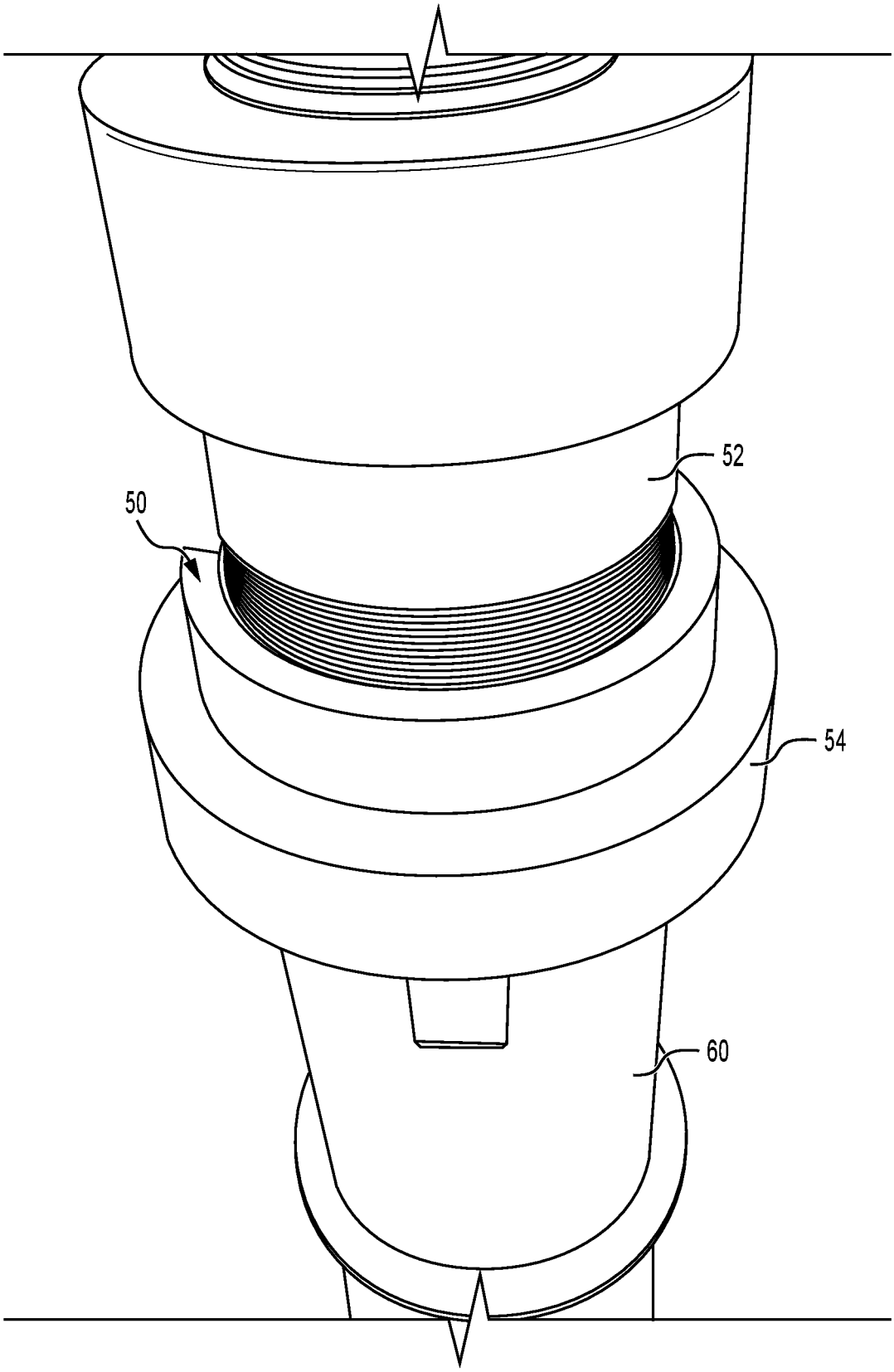
FIG. 5 shows a perspective view of a transfer assembly and an assembly tool.

FIG. 5 shows a perspective view of a transfer assembly 50 and an assembly tool 60 for installing the retaining ring 10*e* into a final product assembly, such as a damper tube. The transfer assembly 50, which may also be called a transfer puck, is used to transfer the retaining ring 10*e* into the assembly tool 60 for installation into the final product assembly, such as a damper tube. The transfer assembly 50 includes a tubular member 52 that encircles and retains the retaining ring 10*e*. The transfer assembly 50 also includes a coupling sleeve 54 disposed around the tubular member 52 and extending axially therefrom and configured to engage and surround the assembly tool 60 for aligning the tubular member 52 with the assembly tool 60 and providing a seamless transfer of the retaining ring 10*e* therebetween. The transfer assembly 50 also includes a plunger 56 that extends through the tubular member 52 and which translates linearly to push the retaining ring 10*e* out of the transfer assembly 50 and into the assembly tool 60.

Figure 6A:
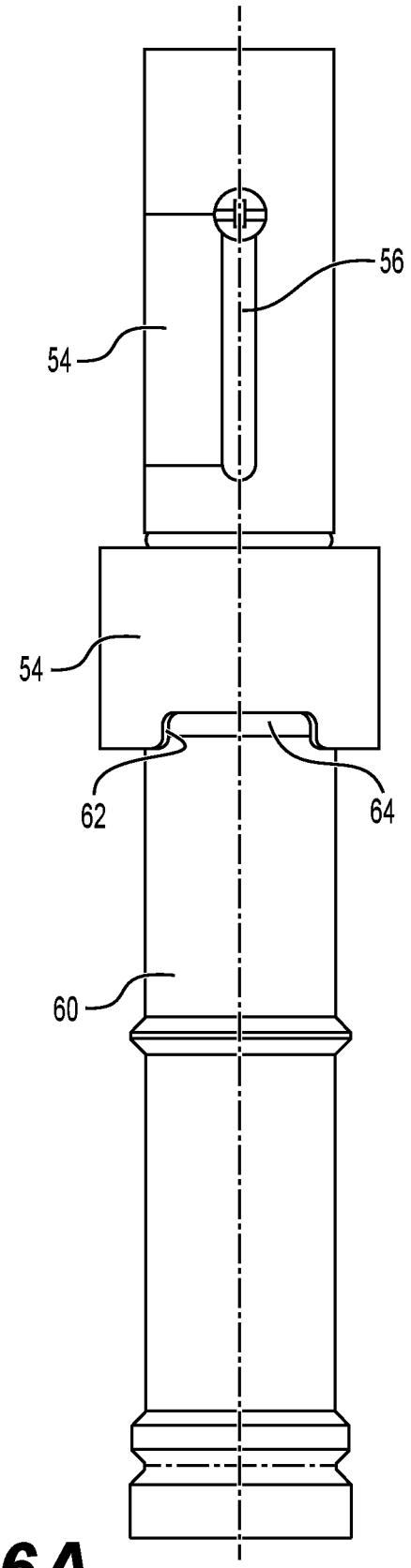
FIG. 6A shows a side view of the transfer assembly.

FIG. 6A shows a side view of the transfer assembly 50 coupled to the assembly tool 60. As shown in FIG. 6A, the coupling sleeve 54 of the transfer assembly 50 also includes a tapered groove 62 configured to receive a corresponding tab 64 of the assembly tool 60. The tapered groove 62 may provide for the transfer assembly 50 to be similarly aligned with each of the forming die 20 and the tubular die 44 for transferring the formed ring 10*d* and the retaining ring 10*e* between each of the forming die 20, the tubular die 44, and the assembly tool 60 using the transfer assembly 50 while maintaining the retaining ring 10*e* in a constrained state throughout the process.

Figure 6B:
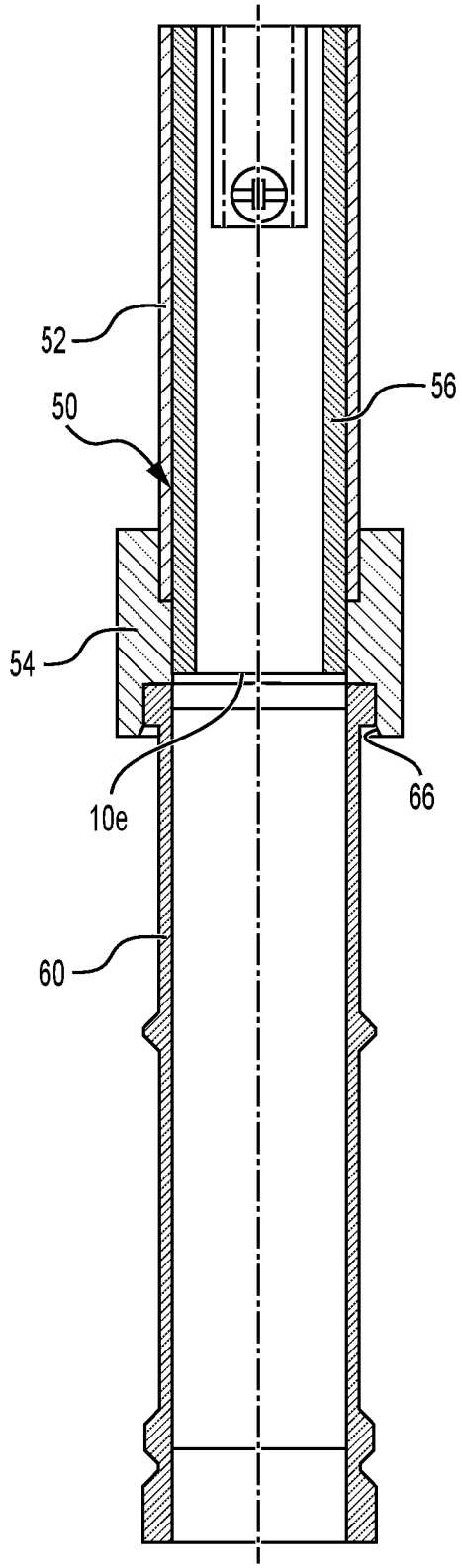
FIG. 6B shows a cross-sectional view of the transfer assembly transferring the retaining ring to the assembly tool.

FIG. 6B shows a cross-sectional view of the transfer assembly 50 transferring the retaining ring 10*e* to the assembly tool 60. As shown in FIG. 6B, the coupling sleeve 54 of the transfer assembly 50 also includes a cylindrical recess 66 with a conical taper for receiving an end of the assembly tool 60 to align the tubular member 52 of the transfer assembly 50 with the assembly tool 60 along a common axis and to facilitate transferring the retaining ring 10*e* therebetween while maintaining the retaining ring 10*e* in the constrained state throughout the process. The cylindrical recess 66 of the coupling sleeve 54 may similarly receive each of the forming die 20 and/or the tubular die 44 for transferring the formed ring 10*d* and/or the retaining ring 10*e* between each of the forming die 20, the tubular die 44, and the assembly tool 60 using the transfer assembly 50 while maintaining the retaining ring 10*e* in a constrained state throughout the process.

Figure 7:
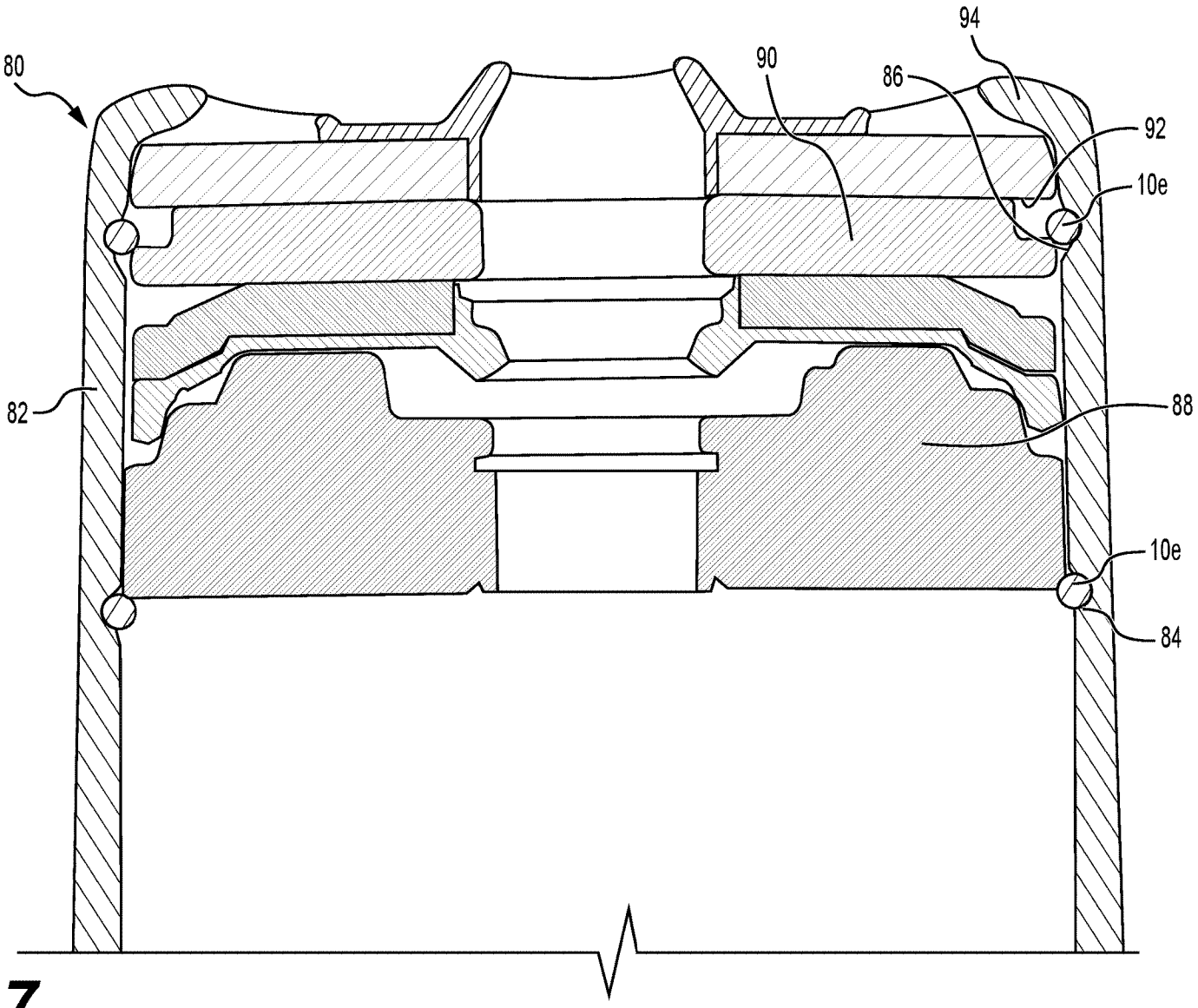
FIG. 7 shows a fragmentary cross-sectional view of a damper tube including two retaining rings.

FIG. 7 shows a fragmentary cross-sectional view of a damper tube 80 including two retaining rings 10*e*. The damper tube 80 may be part of a shock absorber, which may be used in a motor vehicle, such as a passenger car or truck. The damper tube 80 includes a main tube 82 that defines a first annular recess 84 receiving one of the retaining rings 10*e* for holding a rod support 88 at a fixed position in the main tube 82 and preventing the damper rod support 88 from moving in an axial direction. The main tube 82 also defines a second annular recess 86 spaced apart from the first annular recess 84 and receiving another one of the retaining rings 10*e* for holding an end seal assembly 90 at a fixed position in the main tube 82 and preventing the end seal assembly 90 from moving in an axial direction. An axial end of the main tube 82 is bent inwardly to define an annular rim 94 to cooperate with the retaining rings 10*e* for holding the end seal assembly 90 and the damper rod support 88 in a fixed position at or near the axial end of the main tube 82.

The assembly tool 60 may be configured to transfer the retaining rings 10*e* into the main tube 82 of the damper tube 80 while maintaining the retaining rings 10*e* in constrained state. The constrained state may include the retaining rings 10*e* being partially or completely annularly surrounded for holding the retaining rings in a fixed location and orientation.

Figure 8:
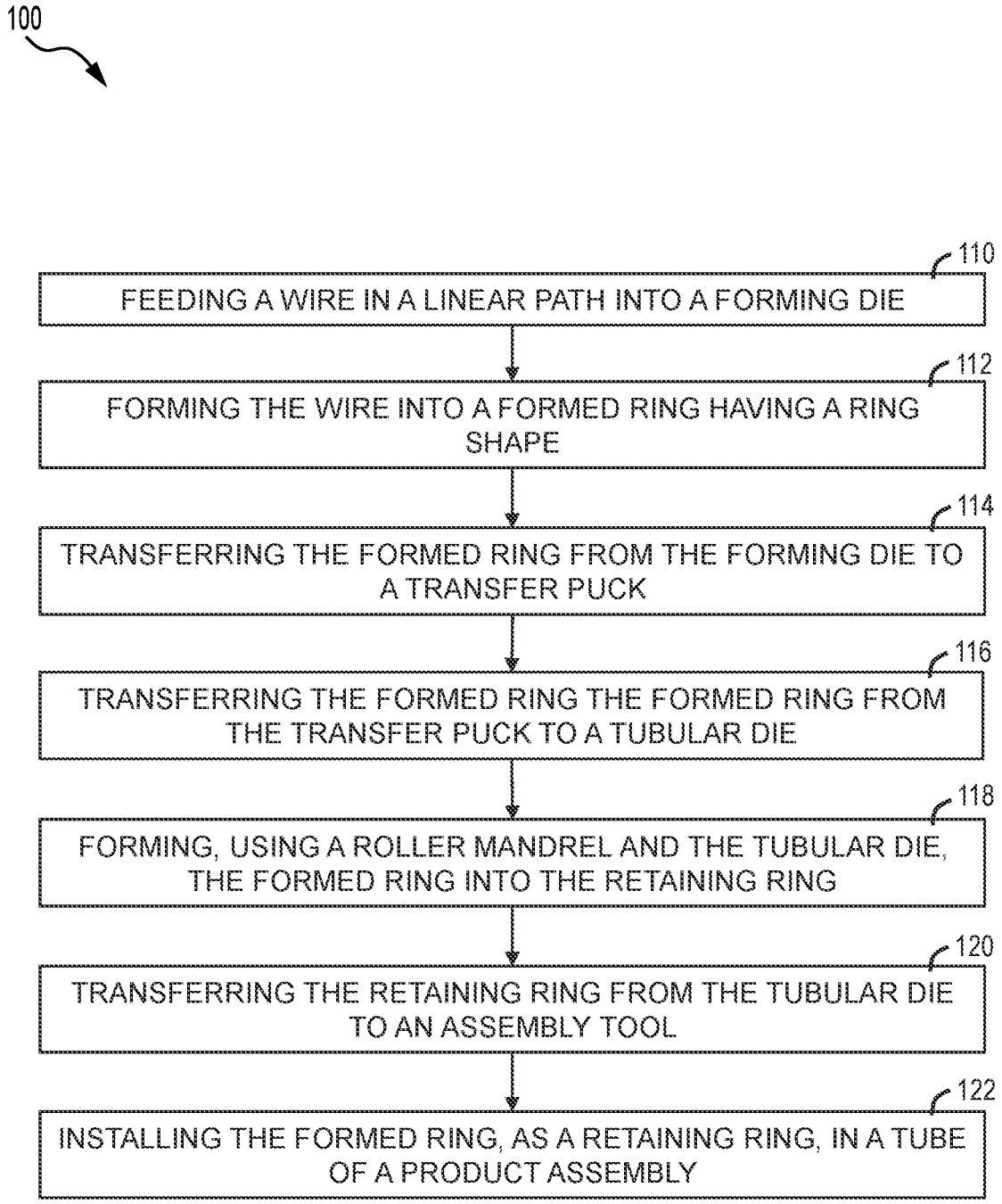
FIG. 8 shows a flow chart illustrating steps in a method for forming and installing a retaining ring in an apparatus.

FIG. 8 shows a flow chart illustrating steps in a method 100 for forming and installing a retaining ring. As can be appreciated in light of the disclosure, the order of operation within the method is not limited to the sequential execution as illustrated in FIG. 8, but may be performed in one or more varying orders as applicable and in accordance with the present disclosure.

The method 100 includes feeding a wire in a linear path into a forming die at step 110. Step 110 may include feeding a segment of wire 10*a* through the tangential aperture 24 and into the forming die 20 of the forming assembly 30. In some embodiments, the wire may include a pre-cut segment of wire. Alternatively, the wire may be an extended length that may be cut after being fed into the forming die. A bulk feeder (not shown in the Figures), such as a wire feed hopper capable of holding numerous pre-cut segments of wire 10*a*, which may be mechanically aligned and positioned with of the forming assembly 30. In some embodiments, a bulk feeder can be reloaded with additional pre-cut segments of wire 10*a* without interrupting the process of forming and installing the retaining rings.

The method 100 also includes forming the wire into a formed ring having a ring shape at step 112. Step 112 may include using forming assembly 30 for producing the formed ring 10*d*. The forming assembly 30 may employ a push die, which may be translated linearly by a dove tail slide (not shown in the Figures). Step 112 may include a pre-cut segment of wire being loaded into a machine breech similar to a bolt action rifle. Step 112 may employ pusher force low enough to utilize a 1.4 mm-diameter pusher pin and allow wire to wrap around tooling inside diameter (ID). The 1.4 mm pusher pin is merely an example, and the pusher pin may be larger than 1.4 mm in diameter or smaller than 1.4 mm in diameter. The pusher pin should have a size and/or material characteristics that are suited for a given size and type of the wire to be formed. The pusher pin may be sufficiently rigid and/or supported against bending so as to remain straight as the wire is formed to the ring shape.

The method 100 also includes transferring the formed ring from the forming die to a transfer puck at step 114. The transfer puck may include a circular bore that encircles the ring and retains the ring thereto.

The method 100 also includes transferring the formed ring the formed ring from the transfer puck to a tubular die at step 116.

The method 100 also includes forming, using a roller mandrel and the tubular die, the formed ring into the retaining ring at step 118. Step 118 may include forming the retaining ring to a finished dimension.

The method 100 also includes transferring the retaining ring from the tubular die to an assembly tool at step 120.

Step 120 may include using the transfer assembly 50 to transfer the retaining ring 10*e* from the tubular die 44 and into the assembly tool 60.

The method 100 also includes installing the formed ring, as a retaining ring, in a tube of a product assembly at step 122. The product assembly may include, for example, the damper tube 80 for a shock absorber.

In some embodiments, the formed ring is maintained in a constrained state between forming in the forming die and installation in the product assembly. In other words, the formed ring may be retained around a peripheral edge and never allowed to be in a free or unrestrained state. The retainer ring may, therefore, be confined to a round, flat configuration through the entire process of finishing, transfer, and installation.

In some embodiments, the forming and installing of the retaining ring at steps 112 through 122 are performed on-demand, proximate in location and in quick succession. For example, steps 112 through 122 may be performed by equipment located in close proximity and without requiring the retaining ring 10*e* to be transported by more than a few meters. Steps 112 through 122 may be performed in quick succession, no more than a few seconds therebetween. In some embodiments, steps 112 through 122, including forming and installing the retaining ring 10*e* may be performed within a fraction of a second.

Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for forming and installing a retaining ring, comprising:

feeding a wire in a linear path into a forming die having a circular bore;

forming, using the forming die, the wire into a formed ring having a ring shape;

transferring the formed ring from the forming die to a transfer puck; and installing the formed ring, as a retaining ring, in a tube of a product assembly, wherein the formed ring is maintained in a constrained state between forming in the forming die and installation in the product assembly.

2. The method of claim 1, wherein the forming and installing of the retaining ring are performed on-demand, proximate in location and in quick succession.

3. The method of claim 1, further comprising transferring the formed ring from the transfer puck to a tubular die; and forming, using a roller mandrel and the tubular die, the formed ring into the retaining ring.

4. The method of claim 3, further comprising transferring the retaining ring from the tubular die to an assembly tool, wherein the assembly tool is configured to install the retaining ring into the product assembly.

5. The method of claim 4, wherein the transfer puck includes a coupling sleeve defining a cylindrical recess configured to receive the assembly tool therein for maintaining the retaining ring in a constrained state as the retaining ring is transferred between the transfer puck and the assembly tool.

6. The method of claim 1, wherein the transfer puck includes a tapered groove configured to align the transfer puck with at least the forming die.

7. The method of claim 1, wherein feeding the wire into the forming die includes feeding a pre-cut segment of the wire into the forming die.

8. The method of claim 1, wherein the product assembly includes a damper tube for a shock absorber.

* * * * *